US005795287A

United States Patent [19]

Ball et al.

[11] Patent Number: 5,795,287

[45] Date of Patent: Aug. 18, 1998

[54] TINNITUS MASKER FOR DIRECT DRIVE HEARING DEVICES

[75] Inventors: Geoffrey R. Ball, Sunnyvale; Bob H. Katz, Los Gatos, both of Calif.

[73] Assignee: Symphonix Devices, Inc., San Jose, Calif.

[21] Appl. No.: 723,855

[22] Filed: Sep. 30, 1996

Related U.S. Application Data

[63] Continuation-in-part of Ser. No. 582,301, Jan. 3, 1996.

[51] Int. Cl.[6] ..... H04R 25/00

[52] U.S. Cl. ..... 600/25; 600/559; 600/28

[58] Field of Search ..... 600/25, 26–28, 600/559; 607/55–57, 136–137; 128/746, 597–98

[56] References Cited

U.S. PATENT DOCUMENTS

| | | | |
|---|---|---|---|
| 4,034,741 | 7/1977 | Adams et al. | 600/28 |
| 4,222,393 | 9/1980 | Hocks et al. | 128/746 |
| 4,226,248 | 10/1980 | Manoli | 128/773 |
| 4,759,070 | 7/1988 | Voroba et al. | 381/60 |
| 4,850,962 | 7/1989 | Schaefer | 600/25 |
| 4,956,391 | 9/1990 | Sapse | 514/810 |
| 4,984,579 | 1/1991 | Burgert et al. | 128/747 |
| 5,015,224 | 5/1991 | Maniglia | 600/25 |
| 5,024,612 | 6/1991 | van den Honert et al. | 604/36 |
| 5,064,858 | 11/1991 | Sapse | 514/536 |
| 5,167,236 | 12/1992 | Junker | 128/746 |
| 5,325,872 | 7/1994 | Westermann | 128/897 |
| 5,403,262 | 4/1995 | Gooch | 600/28 |

OTHER PUBLICATIONS

Jacobson, *Evaluating selective auditory attention*, Hearing Instruments, Mar. 1996, pp. 16–19.

Nodar *Tinnitus reclassified: New oil in an old lamp*, Otolaryngology–Head and Neck Surgery, vol. 114, No. 4, 1996, pp. 582–585.

Sismanis, *Objective tinnitus in Patients with Atherosclerotic Carotid Artery Disease*, The American Journal of Otology, vol. 15, No. 3, May 1994, pp. 404–407.

*Primary Examiner*—John P. Lacyk

*Attorney, Agent, or Firm*—Townsend and Townsend and Crew LLP

[57] ABSTRACT

Tinnitus maskers for direct drive hearing devices are provided. A circuit generates signals corresponding to sounds to mask tinnitus a user perceives. A direct drive hearing device which is coupled to a structure in the user vibrates in response to the signals. The vibrating direct drive hearing device stimulates hearing by vibrating the structure to which it is coupled. A user may select the frequency, intensity and phase of a tone generated. Additionally, a second tone or a background sound may be selected.

28 Claims, 4 Drawing Sheets

TINNITUS MASKER FOR DIRECT DRIVE HEARING DEVICES

This application is a continuation-in-part of U.S. application Ser. No. 08/582,301, filed Jan. 3, 1996, which is hereby incorporated by reference for all purposes.

BACKGROUND OF THE INVENTION

The present invention is related to hearing systems and, more particularly, to tinnitus masker systems for use with direct drive hearing devices.

Tinnitus is the perception of sound when there is none present. It is most often described as "ringing in the ears" but varies from person to person. Some people hear hissing, buzzing, whistling, roaring, high-pitched screeches, or a sound like steam escaping from a radiator. Still others hear one tone or several tones. Twelve million Americans suffer from a severe case of tinnitus and it has been estimated that 20% of the population experiences tinnitus at some time in their lives.

Initially, a person suffering from tinnitus may be worried or frightened because she is unsure what is wrong or how serious is the condition. Although tinnitus itself is not life threatening, some tinnitus sufferers describe the constant noise as irritating while others describe it as maddening. The actual medical cause of tinnitus is not clear but it is believed that some factors such as exposure to loud noise may produce or worsen tinnitus.

Tinnitus maskers alleviate tinnitus by masking out the perceived sound of tinnitus. Conventional tinnitus maskers produce sound of their own to help mask the tinnitus sound. Perhaps the simplest tinnitus masker is a cassette or compact disk player that plays soothing background sounds like rain or surf. It is believed some sufferers find relief because they are able to focus on these soothing sounds and "tune out" the tinnitus sounds. Other conventional tinnitus maskers generate sounds at selected frequencies to cancel out the tinnitus sounds. Thus, "tinnitus masking" will be used herein to generally describe masking out tinnitus sounds by utilizing background sounds, sounds that cancel the tinnitus sounds, or a combination of the two.

An example of conventional tinnitus masker is the Marsona® tinnitus masker, model #1550, available from Marpac Corporation, Wilmington, N.C. The Marsona ® tinnitus masker resembles a clock radio and produces sounds through an integrated speaker. Controls on the unit allow a user to set the frequency and intensity of the sounds produced.

Other conventional tinnitus maskers resemble hearing aids and are placed within the external ear canal. These tinnitus maskers also produce sounds in order to mask the tinnitus sound.

With so many tinnitus sufferers, there is a great need for other methods and systems for masking tinnitus sounds. It is believed that since the direct drive hearing devices rely on direct vibrational conduction, they may mask tinnitus better than conventional acoustic hearing aids.

SUMMARY OF THE INVENTION

The present invention provides an apparatus for tinnitus masker systems utilizing direct drive hearing devices. A circuit generates signals corresponding to sounds to mask tinnitus a user perceives. A direct drive hearing device which is coupled to a structure (e.g., an ossicle) within the user or patient's body vibrates in response to the signals. The vibrating direct drive hearing device stimulates hearing by vibrating the structure to which it is coupled.

In one embodiment, the present invention provides an apparatus for masking tinnitus, comprising: a battery; and a circuit, coupled to the battery, that generates signals for a direct drive hearing device in order to mask tinnitus. Preferably, the direct drive hearing device is a floating mass transducer direct drive hearing device.

In another embodiment, the present invention provides a method of masking tinnitus, comprising the steps of: generating electric signals that correspond to sounds for masking tinnitus; and directly stimulating a structure of a user by vibrating a device coupled to the structure, the device vibrating in response to the electric signals.

Other features and advantages of the present invention will become apparent upon a perusal of the remaining portions of the specification and drawings.

DETAILED DESCRIPTION OF PREFERRED EMBODIMENTS

In the description that follows, the present invention will be described in reference to preferred embodiments. The present invention, however, is not limited to any specific embodiment. Therefore, the description the embodiments that follow is for purposes of illustration and not limitation.

Figure 1:
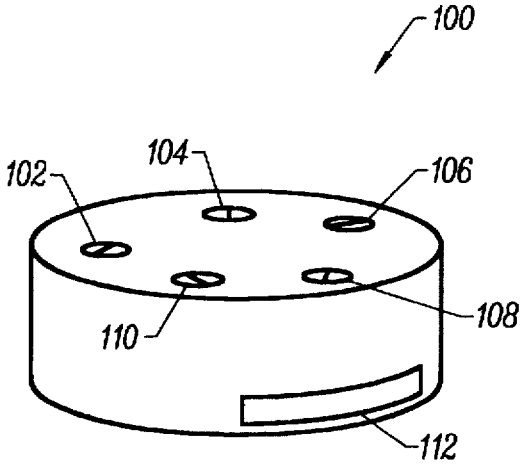
FIG. 1 illustrates an embodiment of the present invention.

FIG. 1 illustrates an embodiment of the present invention. A signal generator 100 generates signals for a direct drive hearing device in order to mask tinnitus. The signal generator includes a multiple user adjustable controls 102,104,106, 108,110, a battery compartment 112, and an integrated circuit (not shown). A battery is placed in the battery compartment in order to provide power to the signal generator.

The adjustable controls allow a user to select characteristics of the signals that the signal generator produces, with the signal corresponding to sounds the user will perceive to mask the tinnitus. In one embodiment, adjustable control 102 allows a user to select the frequency of a primary tone. As the tinnitus sound is often a pure tone, the tinnitus sound may be masked by a signal that is 180° out of phase with the tinnitus sound. In this manner, the tinnitus sound is effectively canceled out by the direct drive hearing device that receives a signal that is 180° out of phase with the tinnitus sound.

Adjustable control 104 allows a user to select the phase of the primary tone. By selecting the phase of the primary tone, the tinnitus may be more effectively masked. A user selects the intensity of signals produced by the signal generator with adjustable control 106.

Some tinnitus sufferers hear multiple tones. A user is able to select the frequency of a secondary tone with control 108. Additionally, an adjustable control may be utilized to set the phase of the secondary tone. Thus, signals corresponding to a primary and secondary tone may be utilized to mask tinnitus.

In other embodiments, the signal generator has controls that allow the user to select the bandwidth for the primary and secondary tones. The bandwidth controls direct the signal generator to produce a range of sounds around the user specified tone. For example, if a user selects a primary tone of 1000 Hertz, the bandwidth control may direct the signal generator to produce tones in the range of 900–1100 Hertz.

Some tinnitus sufferers find relief in listening to soothing background sounds like "white noise," rain, streams, waterfalls, surf, and the like. It is believed that these sufferers find relief because they are able to focus on the soothing background sounds and effectively "tune out" the tinnitus. Regardless of the reason, many tinnitus sufferers find relief from background sounds or noise. Adjustable control 110 allows a user to select the intensity of signals corresponding to background sounds. Additionally, an adjustable control may be utilized to select one of multiple background sounds stored in memory of the signal generator.

Although the user adjustable controls are illustrated as screw-type mechanisms, the user adjustable controls manipulated by the user may also be in the form of dials, sliding mechanisms, switches, and the like. Additionally, embodiments of the signal generator may be fully implanted, the characteristics of the signals produced being set through magnetic switches or set prior to being implanted.

Figure 2:
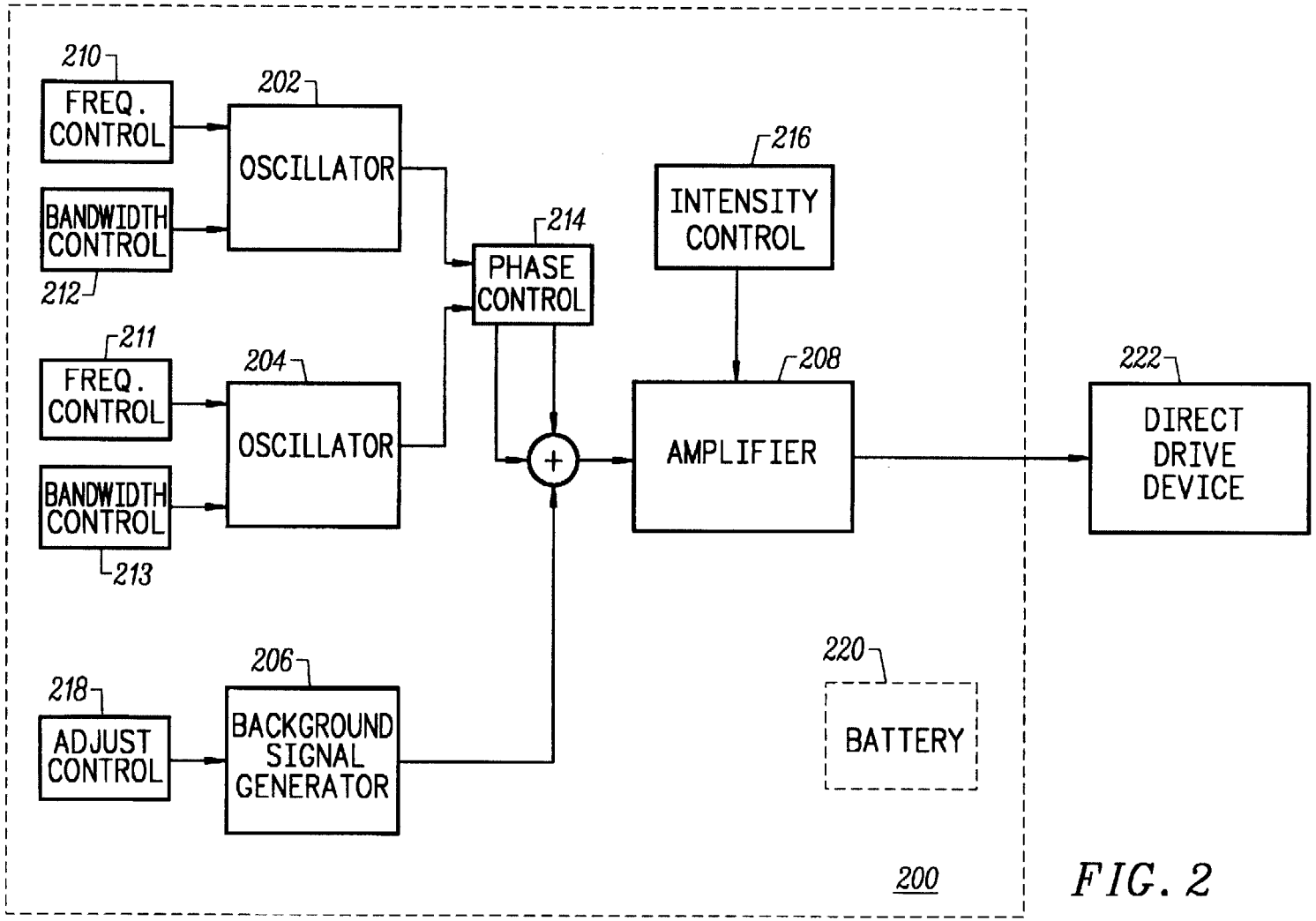
FIG. 2 shows a block diagram of a tinnitus masker system utilizing a direct drive hearing device.

FIG. 2 shows a block diagram of a tinnitus masker system utilizing a direct drive hearing device. The signal generator utilizes an integrated circuit 200. The integrated circuit includes a pair of oscillators 202,204, a background signal generator 206, and an amplifier 208. Frequency controls 210 and 211 determine the frequency of the signals generated by oscillators 202 and 204, respectively. Similarly, bandwidth controls 21 and 213 determine the bandwidth of the signals generated by oscillators 202 and 204, respectively. The frequency and bandwidth controls may be any number of known devices including pentiometers, variable resistors, and the like.

Signals from the oscillators pass through a phase control 214 which may alter the phase of the signals generated by the oscillators. Once through the phase control, the signals are amplified or otherwise modified by an amplifier 208. For example, the amplifier may have an internal frequency which is subtracted from the frequency from the oscillators in order to produce a beat frequency which is in the range of human hearing. Additionally, the amplifier amplifies the signals from the background signal generator 206. An intensity (or amplitude) control 216 adjusts the intensity of the signals generated by the amplifier.

An adjustment control 218 allows a user to select or otherwise alter the background signal generated by background signal generator 206. In one embodiment the adjustment control selects the intensity of the background noise. In another embodiment, the adjustment control allows the user to select the background signal generated. For example, the user may select white noise, rain, streams, waterfalls, or surf that are stored in a memory of the signal generator. In still another embodiment, both controls are utilized.

A battery 220 provides power to the components of integrated circuit 200. The specific connections of the battery will vary depending on the components utilized; however, the battery is typically connected to all the components on the integrated circuit. In fully implanted embodiments, the battery may be rechargeable as through electromagnetic induction.

Amplifier 208 produces a signal corresponding to sounds to mask tinnitus. The amplifier is coupled to a direct drive device 222. The amplifier may be directly electrically connected to the direct drive hearing device as shown or there may be intervening coils to transmit the signals across the user's skin as will be discussed in reference to FIG. 4.

When used herein the term "direct drive hearing device" describes a hearing device that is attached or connected to a structure of a user so that vibration of the hearing device vibrates the structure resulting in perception of sound by the user. Typically, the direct drive hearing device is attached to a vibratory structure of the ear like the tympanic membrane, ossicles, oval window, or round window. However, direct drive hearing devices may also be attached to nonvibratory structures like the skull in order to stimulate hearing by bone conduction.

In preferred embodiments, the direct drive hearing device is a floating mass transducer (FMT) device as is described in U.S. application Ser. No. 08/582,301, filed Jan. 3, 1996, which is incorporated by reference for all purposes. A floating mass transducer device has a "floating mass" which is a mass that vibrates in direct response to an external signal which corresponds to sound waves. The mass is mechanically coupled to a housing which may be mounted on a vibratory structure of the ear. As the mass vibrates relative to the housing, the mechanical vibration of the floating mass is transformed into a vibration of the vibratory structure allowing the user to hear.

Although preferred embodiments of the direct drive hearing device are floating mass transducer devices, other direct drive hearing devices may be utilized. For example, a direct drive hearing device may include a magnet attached to a vibratory structure which as driven by a coil anchored separately within the inner ear is described in U.S. Pat. No. 5,015,225, issued May 14, 1991 to Maniglia et al., which is hereby incorporated by reference for all purposes. Additionally, a direct drive hearing device may include a electromechanical transducer having an outer tubing member having a bellows member attached to the end of the outer tubing member as described in U.S. Pat. No. 5,282,858, issued Feb. 1, 1994 to Bisch et al., which is hereby incorporated by reference for all purposes.

Figure 3:
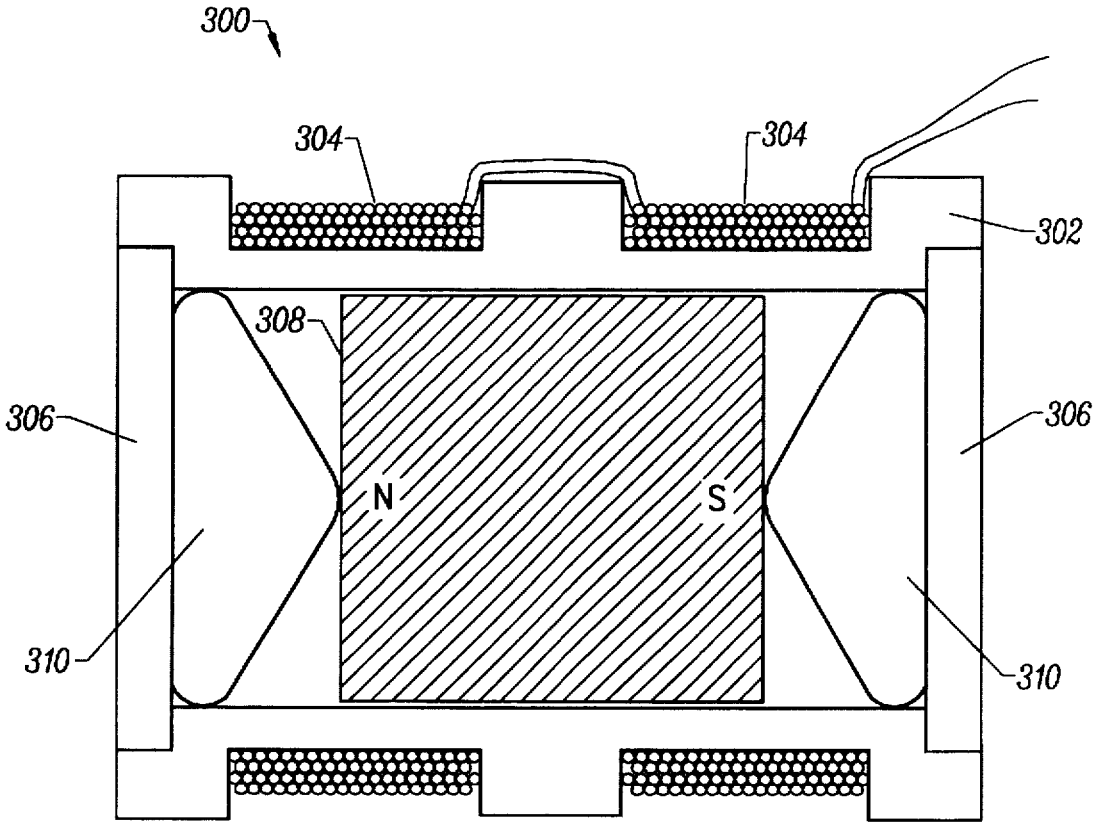
FIG. 3 shows an exemplary direct drive hearing device.

FIG. 3 shows an exemplary direct drive hearing device in the form of a floating mass transducer. Floating mass transducer 300 has a cylindrical housing 302. The housing has a pair of notches on the outside surface to retain or secure a pair of coils 304. The coils may be made of various metallic materials including gold and platinum. The housing retains the coils much like a bobbin retains thread. The housing includes a pair of end plates 306 that seal the housing. The housing may be constructed of materials such as titanium, iron, stainless steel, aluminum, nylon, and platinum. In one embodiment, the housing is constructed of titanium and the end plates are laser welded to hermetically seal the housing.

Within the housing is a cylindrical magnet 308 which may be a SmCo magnet. The magnet is not rigidly secured to the inside of the housing. Instead, a biasing mechanism supports, and may actually suspend, the magnet within the housing. As shown, the biasing mechanism is a pair of soft silicone cushions 310 that are on each end of the magnet. Thus, the magnet is generally free to move between the end plates subject to the retention provided by the silicone cushions within the housing. Although silicone cushions are shown, other biasing mechanisms like springs and magnets may be utilized.

When electrical signals corresponding to sound to mask tinnitus pass through coils 304, the magnetic field generated by the coils interacts with the magnetic field of magnet 308. The interaction of the magnetic fields causes the magnet to vibrate within the housing. Preferably, the windings of the two coils are wound in opposite directions to get a good resultant force on the magnet (i.e., the axial forces from each coil do not cancel each other out). The magnet vibrates relative to the housing within the housing and is biased by the biasing mechanism within the housing. The vibrations of the magnet cause the housing, and structures it is attached to, to vibrate.

The resonant frequency of the floating mass transducer may be determined by the "firmness" by which the biasing mechanism biases the magnet. For example, if a higher resonant frequency of the floating mass transducer is desired, springs with a relatively high spring force may be utilized as the biasing mechanism. Alternatively, if a lower resonant frequency of the floating mass transducer is desired, springs with a relatively low spring force may be utilized as the biasing mechanism.

It is known that an electromagnetic field in the vicinity of a metal induces a current in the metal. Such a current may oppose or interfere with magnetic fields. Although a thin metal layer such as titanium separates coils 304 and magnet 308, if the metal layer is sufficiently thin (e.g., 0.05 mm) then the electromagnetic interference is negligible. Additionally, the housing may be composed of a nonconducting material such as nylon. In order to reduce friction within the housing, the internal surface of the housing and/or the magnet may also be coated to reduce the coefficient of friction.

Figure 4:
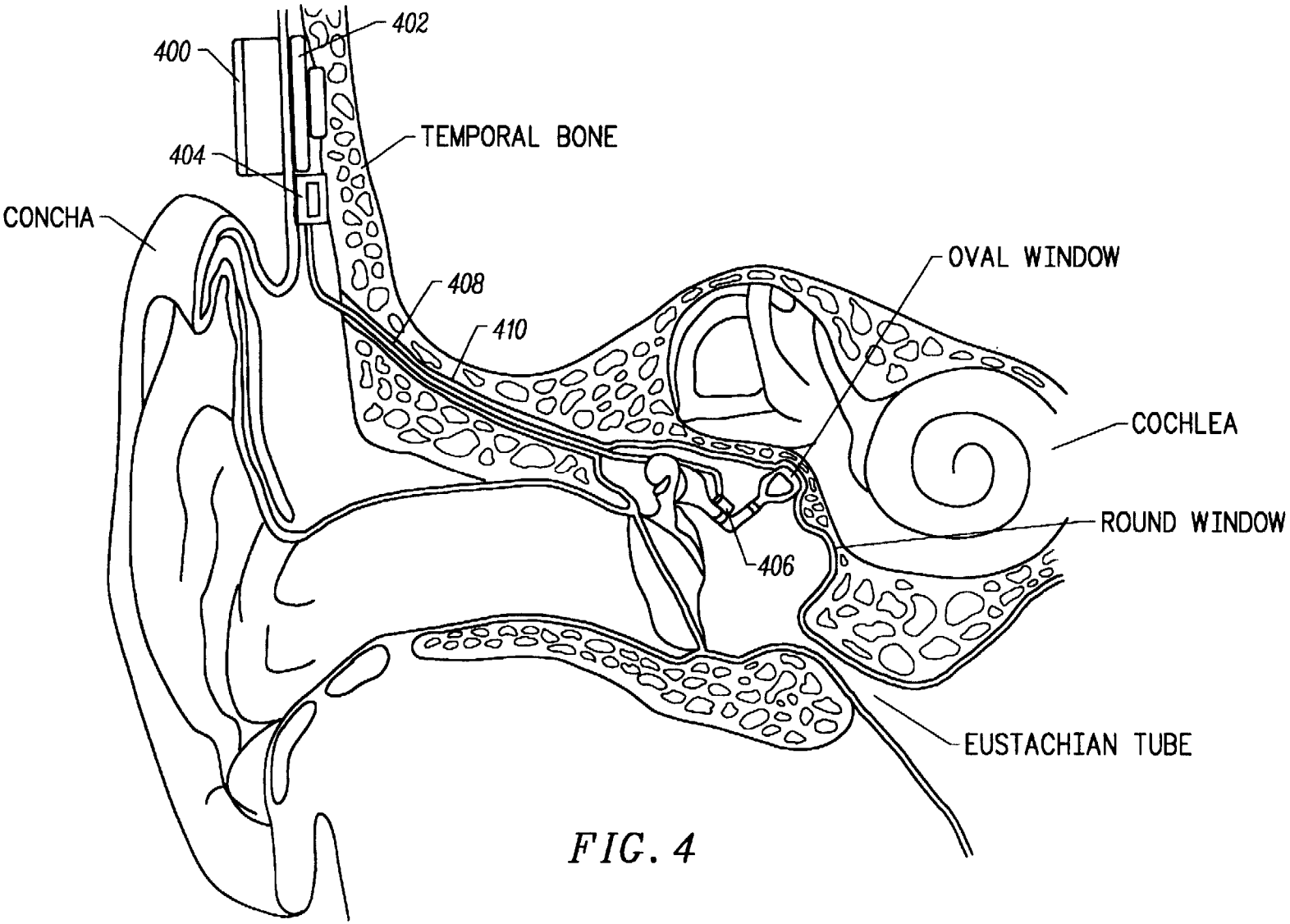
FIG. 4 shows a cross-sectional view of a user's ear having an implanted tinnitus masker.

FIG. 4 shows a cross-sectional view of a user's ear having an implanted tinnitus masker. An signal generator 400 generates signals to mask tinnitus. The signals are transmitted to an implanted receiver 402 by use of a coil within the signal generator. Receiver 402 includes a coil to receive the signals transcutaneously from the signal generator in the form of varying magnetic fields. As shown, the receiver is placed under the skin and converts the varying magnetic fields to electrical signals. A demodulator 404 demodulates the electrical signals which are transmitted to floating mass transducer 406 via leads 408. The leads reach the middle ear through a channel 410 that has been cut in the temporal bone during implantation of the floating mass transducer.

Floating mass transducer 406 is attached to the incus by a clip. Other attaching mechanisms include bone cement, screws, sutures, and the like.

During operation, the floating mass transducer vibrates in response to electrical signals corresponding to sounds to mask tinnitus. As the floating mass transducer is securely attached to a structure of the user (e.g., a vibratory structure), the vibrations are transmitted to the inner ear for the user to perceive the sounds.

While the above is a complete description of preferred embodiments of the invention, various alternatives, modifications and equivalents may be used. It should be evident that the present invention is equally applicable by making appropriate modifications to the embodiments described above. For example, the above has shown that the signal generator is external; however, a signal generator may be implanted to form a fully implantable tinnitus masker system including a direct drive hearing device. Therefore, the above description should not be taken as limiting the scope of the invention which is defined by the metes and bounds of the appended claims along with their full scope of equivalents.

What is claimed is:

1. An apparatus for masking tinnitus, comprising:

a battery;

a circuit, coupled to the battery, that generates signals; and a direct drive hearing device that receives the signals from the circuit which correspond to sound a user will perceive in order to mask tinnitus.

2. The apparatus of claim 1, wherein the direct drive hearing device receives the signals from the circuit in order to vibrate a structure within a user's body to stimulate hearing in order to mask tinnitus.

3. An apparatus for masking tinnitus, comprising:

a battery;

a circuit, coupled to the battery, that generates signals; and a direct drive hearing device that receives the signals from the circuit which correspond to sound a user will perceive in order to mask tinnitus, wherein the direct drive hearing device is a floating mass transducer device.

4. The apparatus of claim 1, wherein the circuit generates signals corresponding to a frequency of a first tone to mask tinnitus.

5. The apparatus of claim 4, wherein the circuit generates signals corresponding to a frequency of a second tone to mask tinnitus.

6. The apparatus of claim 1, wherein the circuit generates signals corresponding to a background sound to mask tinnitus.

7. The apparatus of claim 4, further comprising an adjustable control for selecting a frequency of the first tone.

8. The apparatus of claim 4, further comprising an adjustable control for selecting an intensity of the first tone.

9. The apparatus of claim 4, further comprising an adjustable control for selecting a phase of the first tone.

10. The apparatus of claim 4, further comprising an adjustable control for selecting a bandwidth around the first tone.

11. The apparatus of claim 5, further comprising an adjustable control for selecting a frequency of the second tone.

12. The apparatus of claim 5, further comprising an adjustable control for selecting a phase of the second tone.

13. The apparatus of claim 5, further comprising an adjustable control for selecting a bandwidth around the second tone.

14. The apparatus of claim 6, further comprising an adjustable control for selecting an intensity of the background sound.

15. The apparatus of claim 6, wherein the background sound is selected from the group consisting of white noise, rain, streams, waterfalls, and surf.

16. The apparatus of claim 1, further comprising a pair of coils that transmit the signals from the circuit to the direct drive hearing device through skin of a user.

17. The apparatus of claim 1, wherein the apparatus is adapted to be fully implantable within a Patient's body.

18. An apparatus for masking tinnitus, comprising:

a battery;

a circuit, coupled to the battery, that generates electric signals; and a direct drive hearing device that receives the electric signals from the circuit which correspond to sound a user will perceive in order to vibrate a structure within a user's body in response to the electric signals to stimulate hearing in order to mask tinnitus.

19. The apparatus of claim 18, wherein the direct drive hearing device is a floating mass transducer device.

20. The apparatus of claim 18, further comprising adjustable controls for directing the circuit to generate signals corresponding to frequencies of a first tone and a background sound to mask tinnitus.

21. The apparatus of claim 20, wherein the circuit further generates signals corresponding to a frequency of a second tone to mask tinnitus.

22. The apparatus of claim 20, further comprising an adjustable control for selecting a phase of the first tone.

23. The apparatus of claim 20, wherein the background sound is selected from the group consisting of white noise, rain, streams, waterfalls, and surf.

24. A method of masking tinnitus, comprising the steps of:

generating electric signals that correspond to sounds for masking tinnitus; and directly vibrating a structure of a user by vibrating a device coupled to the structure, the device vibrating in response to the electric signals.

25. The method of claim 24, further comprising the step of selecting a frequency, intensity, and phase of a first tone.

26. The method of claim 24, further comprising the step of selecting a bandwidth around a first tone.

27. The method of claim 24, further comprising the step of selecting a frequency of a second tone.

28. The method of claim 24, further comprising the step of selecting a background sound.

* * * * *